US005433093A

United States Patent [19]

Sooth

[11] Patent Number: 5,433,093

[45] Date of Patent: Jul. 18, 1995

[54] DEVICE COMPRISING A LOCKING BAR

[76] Inventor: Ole Sooth, Näverlursgatan 8, S-421 44 Västra Frölunda, Sweden

[21] Appl. No.: 50,493

[22] PCT Filed: Nov. 21, 1991

[86] PCT No.: PCT/SE91/00789

§ 371 Date: May 21, 1993

§ 102(e) Date: May 21, 1993

[87] PCT Pub. No.: WO92/09774

PCT Pub. Date: Jun. 11, 1992

[30] Foreign Application Priority Data

Nov. 22, 1990 [SE] Sweden ..... 9002940

[51] Int. Cl.[6] ..... E05B 67/38

[52] U.S. Cl. ..... 70/56; 70/39; 70/416; 297/148

[58] Field of Search ..... 70/14, 18, 35, 38 R, 70/39 A–39 C, 52–58, 416–419, 129; 292/148

[56] References Cited

U.S. PATENT DOCUMENTS

| | | | |
|---|---|---|---|
| 1,690,041 | 10/1928 | Sundquist | 70/53 X |
| 4,106,315 | 8/1978 | Dohanyos | 70/56 |
| 4,286,814 | 9/1981 | Harrington et al. | 70/55 X |
| 4,438,641 | 3/1984 | Levkov | 70/417 X |
| 4,480,450 | 11/1984 | Brown | 70/14 |
| 4,548,058 | 10/1985 | Bahry et al. | 70/56 |
| 4,648,255 | 3/1987 | Gartner | 70/417 |
| 4,802,351 | 2/1989 | Kojak | 70/56 |
| 4,852,921 | 8/1989 | Gilbert et al. | 292/288 X |
| 4,883,294 | 11/1989 | Goodspeed | 292/148 |
| 4,905,486 | 3/1990 | Appelbaum | 70/54 |
| 4,972,689 | 11/1990 | Anderson | 70/417 X |
| 5,123,267 | 6/1992 | Appelbaum | 70/54 X |

FOREIGN PATENT DOCUMENTS

| | | | |
|---|---|---|---|
| 878005 | 5/1953 | Germany . | |
| 2916167 | 11/1979 | Germany | 70/418 |
| 164985 | 6/1990 | Japan | 70/416 |
| 436508 | 12/1984 | Sweden . | |
| 2058196 | 4/1981 | United Kingdom | 70/56 |
| 2194818 | 3/1988 | United Kingdom . | |

*Primary Examiner*—Peter M. Cuomo
*Assistant Examiner*—Suzanne L. Dino

[57] ABSTRACT

An arrangement is disclosed involving a locking bar, which arrangement is to be used for locking doors, containers and the like. The arrangement includes a locking bar which is layered at one end or to the base with its other free end involving a locking shackle holder with a shackle which is insertable in a cooperating locking device, which includes of a casted or smithed strong housing member in one piece without other openings except for a key hole and an opening for receiving the locking shackle and an exchangeable lock for fastening of the locking shackle.

3 Claims, 3 Drawing Sheets

DEVICE COMPRISING A LOCKING BAR

BACKGROUND OF THE INVENTION

1. Field of the Invention

This invention is a device containing a locking bar which cooperates with a locking arrangement. The device is to be used for doors, stores, containers and for protection for lorry building-ups.

2. Description of Related Art

A lot of different devices for locking doors and similar in connection with a locking bar are earlier known. These generally consist of a rotating or telescoping locking bar which can be locked in some way to a block house. The degree of security against burglary and destruction of these arrangements vary significantly. In Sweden such burglary protecting fittings and locking arrangements are classified by the Burglary Protection Association (SSF) and the Insurance Companies' Service AB (FSAB). Classification is divided in five steps where 5 is the highest grade of classification that can be reached. Extremely hard tests are to be performed to be able to reach class 5, and therefor such classification is very rare. Most constructions of high class achieve, because of this, classification grade 4 or lower. To be able to reach this class both fitting and locking device must resist stretching strengths of 7000 kilopound. This is to be compared with that of the strength which all latch locks have is of the measure 700 kilopound thus 1/10 of what is required for classification in class 4.

An example of earlier known locking arrangements involving a locking bar is described in Swedish patent 8301668-3. This device involves a locking bar which is removable in a loop on one of the doors and which is removable in the locking device on the other door. The loop in the first door is anchored on the plate with a bolt hole going through for fastening in the door. The bolts are thus reachable from the outside and can easily be sawn off. The locking device in the other door involves a house which is welded on a carrying plate which can be bolted in a similar way to the bottom layer. Moreover on the house a further protection is welded. This protection does not stretch itself around the whole house and it is welded on the upper side only. With the help of tools it is therefore easily broken off.

The locking bar in this known device has one side open and consequently it can therefore be exposed to blows or any pressure whatsoever. The latch bolt from the locking house can thus be blown off. Another inconvenience with this device is that if this locking device involving a key should break, the whole locking arrangement must be discarded. The lock house is namely by different weldings which are not exchangeable.

Further devices for locking doors are described in U.S. Pat. Nos. 4,106,315, 4,905,486 and 4,548,058. Characteristic of these patents is that in spite of good production they are simple to break on account of easy reachability with tools. They also have a complicated construction and are consequently expensive in production. By eventual damage on the locking mechanism the whole device has to be thrown away as exchangeable parts do not exist.

SUMMARY OF THE INVENTION

The purpose of this invention has been to construct a locking device which is completely guarded, making it impossible to gain access at any place with tools in order to break it up. A further purpose with this invention has been that it shall be able to be adapted to different types of locking mechanisms, which thus should be exchangeable. One purpose with this invention has also been to facilitate a non expensive device to produce, but in spite of this to perform the necessary strength and to be able to be classified in the highest grade 5 as above.

The technical problem as above has been solved by this invention, by which one has created a device involving a locking bar which bar is fastened or turnably journalled at one end and at the other end is cooperating with a locking device which device is characterized in that the locking bar at its other end in a longitudinal cavity carries a longitudinally movable shackle holder with a shackle, which is insertable into the locking device, which locking device consists of a casted or forged strong integral house without any other openings to the surroundings than a key hole and a second opening for the reception of the locking shackle, which second opening is covered by the locking bar when the shackle is introduced into the house and inside the house an exchangeable lock for receiving and locking the shackle.

According to the invention it is suitable that the shackle holder is longitudinally divided in two parts and holds the shackle by means of the two parts being screwed together around and between the shackle.

The invention is furthermore also identified in that stopping lugs are arranged within the house partly for receiving pressure forces from the shackle holder and partly for fastening the lock.

According to the invention it is important that the house is applicable to a wall or the like by means of bolts or similar element going through the wall which terminate in the house and are covered by the house.

It is suitable that the bolt holes in the device are furnished with a ball on the bottom to hinder penetration with drilling tools.

BRIEF DESCRIPTION OF THE DRAWINGS

The invention will be described closer with reference to the drawings as follows.

DETAILED DESCRIPTION OF PREFERRED EMBODIMENTS

Figure 1:
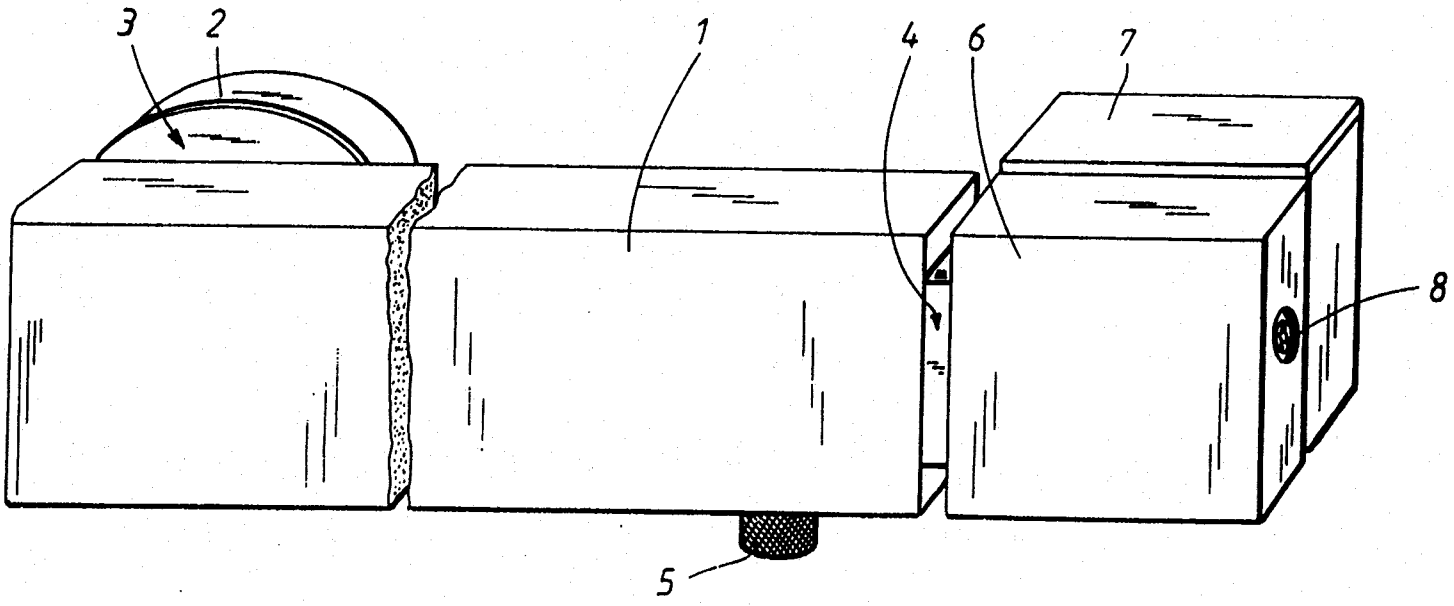
FIG. 1 is showing a perspective view of the device in accordance with this invention.

In FIG. 1 the bar is described by the numeral 1. This is in the presented form turnably fastened with its one end on a foundation via a middle part 2, to which the bar 1 is screw fastened via a welded plate 3. Inside the bar 1 and showing slightly in the drawing a slide or shackle holder 4 is arranged. This shackle holder 4 is movable in the bar 1 by means of a handle 5, which is moving in a slit underneath the bar. The shackle holder 4 is as shown by the drawing inserted in a housing 6 which by means of middle piece 7 is screw fastened to a different material layer than the one which the bar 1 is screw fastened on. It is obvious from the drawing that no openings, traces or weldings are reachable on the entire device apart from the keyhole 8, which one can not be without.

Figure 2:
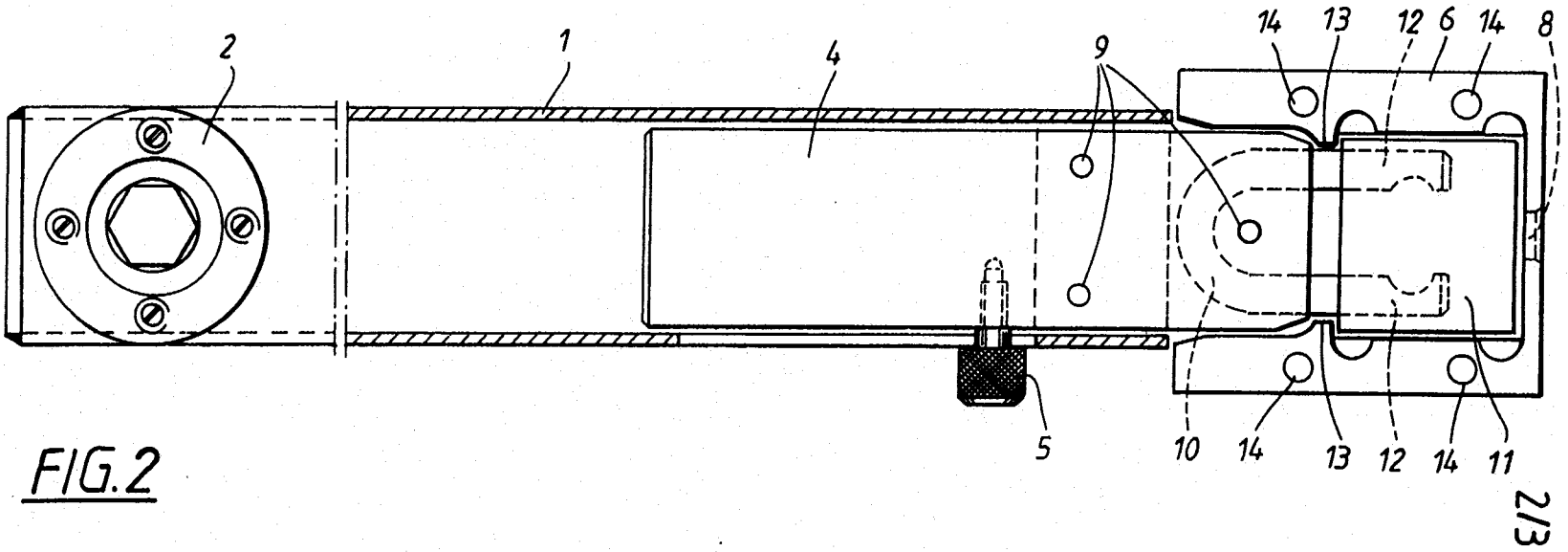
FIG. 2 shows the same device seen from the side and partly in length section.

FIG. 2 shows partly in section the same arrangement as shown in FIG. 1, but partly in section. Thus in bar 1, which can be square or have another form, e.g. circular, there is a slide or shackle holder 4 stretching itself a suitable distance into bar 1. This slide or shackle holder 4 is in this case in a forward position, viz. it has been moved into housing 6. Slide 4 is axially divided into two parts at its outer end and the two parts can be screwed together by means of screws 9. On the surfaces between these two halves, tracks have been made for installment of a shackle 10. When the two halves by means of the screws 9 stretch together against each other the shackle 10 will be pressed and secured between same. As in the locked position as shown in the drawing, the screws 9 are completely hidden partly in bar 1 and partly the housing 6 and will not be reachable from the outside. It is also shown in the drawing that the bar 1 hardly touches the housing 6 so that the slide 4 is practically hidden and can not be influenced either by outside forces or tools.

In the housing 6 there is a locking house 11 arranged. This can be of any different type and completely guarded in the housing 6 and not reachable in any way but through the keyhole 8. This locking house 11 locks the ends 12 of the shackle. Because of the fact that the locking house 11 as well as the shackle holder 4 are completely hidden, no forces for parting of these parts can be placed against them.

Instead having a shackle of performance characteristics shown, other arrangements can be used such as two pins with tracks similar to those shown in FIG. 1 which are not connected by a bow but are locked by tracks similar to those shown at the ends of shackle 12 in the shackle holder or slide 4. As the lock 11 is not a part of the invention this could be of a different kind and the shackle 10 with the ends of the shackle 12 can consequently be of an entirely different kind such as a tap or a hook or similar arrangement.

As shown in the drawing the hollowness in the housing 6 containing the locking house 11 is limited by two stopping pieces 13. These stopping pieces 13 prevent locking house 11 from being drawn out at an open lock and also hinder the slide or shackler holder 4 from hitting against the locking house 11. Any hits against the bar 1 in an axial direction does not interfere with the locking house or the slide because the slide is moveable therein.

The house 6 is provided with four bolt holes 14 for fastening with a support. These bolt holes 14 are not through going and can only be reached from the inside of the support which suitably is a door or a wall. They are thus completely protected from the outside. The housing 6 is otherwise open against the inside against the wall which means that if the locking house 11 should cause trouble, it can be removed and replaced without any difficulty. By having different sizes of spaces for the locking house 11 also different sizes of locks can be used.

Figure 3:
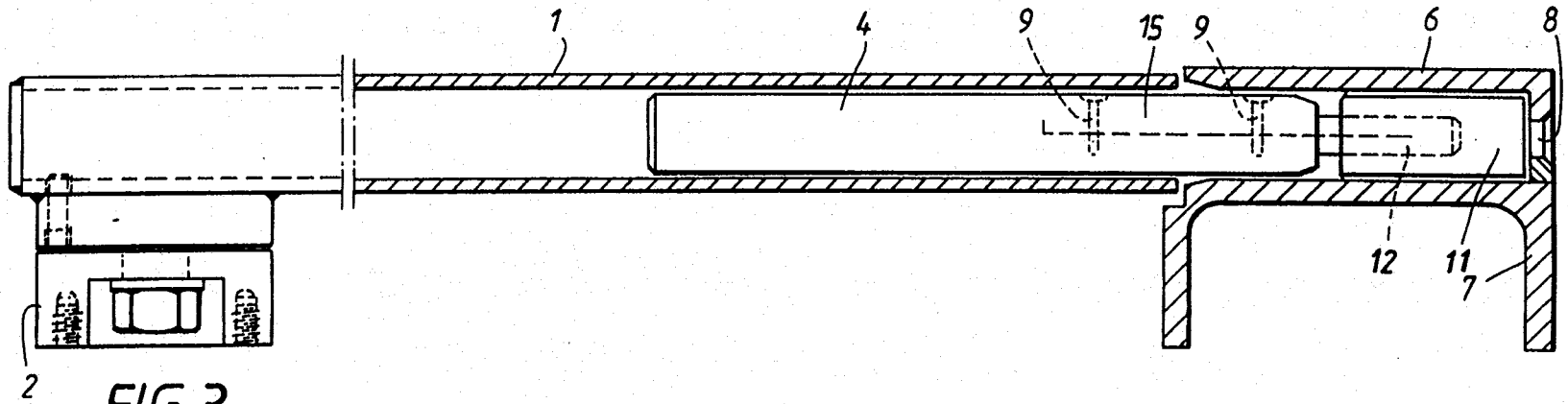
FIG. 3 shows the device according to FIG. 2 shown partly in section from above; and, FIG. 4 shows in section a part of the fastening arrangement to the foundation.

FIG. 3 shows a section of the same arrangement as the one according to FIG. 2. The same references are applicable even for this. As is clearly shown, shackle holder 4 is axially divided at its one end and has been shaped so that an upper dismountable part 15 is fastened in the lower part of the shackle holder 4. Screws 9 fasten this against the lower part and press the shackle 10 fastened between the parts in which tracks for this shackle have been made. As shown quite clearly the screws 9 are completely covered and can not be reached from the outside.

Figure 4:
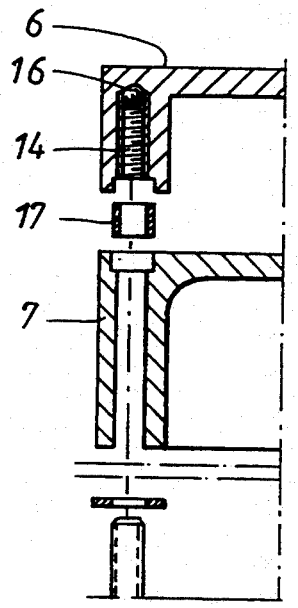

FIG. 4 finally shows how the housing 6 is fastened at the fundament. In the present case a middle piece 7 has been arranged. The bolt holes 14 are threaded and do not reach all the way to the surface. Instead at the bottom of the bolt hole a ball 16 has been inserted. This ball is meant to be a protection against drilling from the outside, which could loosen the whole package. If the drill should penetrate from the outside and hit the ball it will start rotating together with the drill which, consequently, would not penetrate further. For safe fastening of the middle piece 7 at the housing 6, a socket shaped extra middle piece 17 has been arranged with a track in the middle piece 7 and the housing 6. Gathered from the above the arrangement consists in accordance with the presented invention of one unit which only has a key hole outwards besides a lever for transportation the shackle holder. The parts are produced in single pieces without any being visible and reachable welding joints and the material has been made so thick that any serious damage of the arrangement can not be created without the help of explosives or the like. A suitable thickness of the material of the house and the locking bar is 15 millimeters when it consists of steel. In accordance with the invention it is suitable that the steel is hardened according to the method of carbon nitride.

In accordance with the invention presented a locking bar arrangement is created which is extremely strong fulfilling the demands of the highest security grade 5 in accordance with the above mentioned norms and is not expensive to manufacture. It also gives possibilities to change locks in a simple way which lock is not in itself needed to be of highest classification. This stimulates the economic side of the arrangement.

I claim:

1. A locking device comprising:

a locking bar fastened at one end to a support;

a longitudinally movable shackle holder with a shackle formed within the other end of said locking bar;

a housing member surrounding an exposed end of said shackle holder and shackle, said housing member including a keyhole formed in an end wall thereof, an opening for receiving said shackle holder and shackle, and side walls formed between the end wall and the opening;

at least one stopping lug integrally formed on an inner peripheral surface of said housing member and projecting toward an inner cavity thereof; and an exchangeable locking house secured within said housing member adjacent the end wall thereof by said at least one inner peripheral stopping lug, wherein ends of the shackle and at least a portion of said shackle holder are insertable into said locking house and the open end of said housing member abuts against the other end of said locking bar.

2. The device according to claim 1, wherein said shackle holder is longitudinally divided into two parts, the shackle being secured between the two parts of said shackle holder.

3. The device according to claim 1, wherein said housing member is securable to a wall or door by bolts which end within said housing member.

* * * * *